US005185587A

United States Patent [19]

Kurian et al.

[11] Patent Number: 5,185,587

[45] Date of Patent: Feb. 9, 1993

[54] COMPACT TANDEM NON-RECIPROCAL CIRCUIT

[75] Inventors: Thampy Kurian, Stow; Leo Maloratsky, Brookline, both of Mass.

[73] Assignee: Renaissance Electronics Corp., Stow, Mass.

[21] Appl. No.: 716,382

[22] Filed: Jun. 17, 1991

[51] Int. Cl.[5] ..... H01P 1/387

[52] U.S. Cl. ..... 333/1.1; 333/24.2

[58] Field of Search ..... 333/1.1, 24.2

[56] References Cited

U.S. PATENT DOCUMENTS 4,276,522 6/1981 Coerver ..... 333/1.1

FOREIGN PATENT DOCUMENTS 3006486 8/1981 Fed. Rep. of Germany ..... 333/1.1
240101 10/1988 Japan ..... 333/1.1
55406 2/1990 Japan ..... 333/1.1

*Primary Examiner*—Paul Gensler

[57] ABSTRACT

A compact multi-junction ferrite circulator/isolator in which ferrites, junctions with center conductors and permanent magnet are situated in a stacked manner with common center line within non-magnetic housing. A magnetic circuit also has C-shaped members each having shield, return and ground plane portions. The permanent magnet is located in between the ground plane portions of two C-shaped members. In this tandem circuit one permanent magnet and two ferrites having cross section area of those in a single circuit and less expensive round ferrite shape might be used. It gives a uniform magnetic flux which, in turn, provides better tandem circuit properties. The stacked situation of all principal tandem circuit members also gives the best horizontal integration. Vertical portion of a dielectric film within the tandem circuit might be used for a communication line application, for example, for an amplifier giving the highest level of integration.

5 Claims, 3 Drawing Sheets

COMPACT TANDEM NON-RECIPROCAL CIRCUIT

FIELD OF THE INVENTION

The invention herein presented relates to a ferrite circulator/isolator of the strip transmission line type connected in tandem with a common magnetic field to extend over the whole unit, and a common line situated between a pair of center conductors. More particularly, the invention pertains to compact and efficient arrangements of two or more non-reciprocal circuits.

BACKGROUND OF THE INVENTION

The conventional manner of connecting strip line ferrite circulator/isolators in tandem is to abut them in a widespreading manner with a common boundary of their ferrites (see, for example, U.S. Pat. No. 3,534,296). The disadvantages of this manner of connecting are as follows:

a widespreading area of the abutted circuits is increasing proportionally to the quantity of the connected circuits causing low integration level of tandem;

a cross section area of a magnet is approximately equal to the summarized area of all ferrites in the abutted circuits causing nonuniformity of common magnetic field and, in turn, a degradation of the circuit quality;

in order to abut ferrites, each of them should have at least one side flat plane that excludes the usage of the less expensive round-shaped ferrites;

usage of a transmission in between tandem-connected circuits (that is a very convenient manner, say, for amplifiers to put in a circuit in between connected center conductors), causing increased magnet area, and, additionally, a ferrite application as a center conductor substrate causing more dielectric losses compared with application of a dielectric substrate.

It is desirable that widespreaded area of tandem-connected circuits would not be increased compared with the area of a single circuit. It is also desirable that a magnet and a ferrite area of the tandem would be the same as that of a single circuit. It is further desirable that a ferrite in the tandem would have the most inexpensive round shape. It is desirable as well that in case of some transmission line should be located in between the tandem-connected circuits, their widespreaded dimensions would not be increased, and a dielectric substrate film could be conveniently used instead of a ferrite substrate.

SUMMARY OF THE INVENTION

The invention herein presented is a compact tandem non-reciprocal circuit, comprising a housing, a pair of junctions each with center conductors, a pair of ferrites, a magnetic circuit with a permanent magnet, wherein said pair of junctions, said pair of ferrites, and said permanent magnet are situated in a stacked manner with common center line within said housing, said magnetic circuit having a pair of C-shaped members each comprising shield, ground plane, and return portions, provided that said shield portions are located toward outside of said tandem circuits, said permanent magnet is located in between inner surfaces of said ground plane portions and in contact with them, and ferrites are located each on outer surface of said ground plane portion, said pair of junctions with center conductors each is applied on a horizontal portion of a dielectric film operatively having C-like shape, provided that said horizontal portions are lying each on a surface of said ferrite, and the vertical portion of said film is used for application of a transmission line connected to said pair of center conductors. Said housing is made out of a non-magnetic material. Each of said shield portions is provided with a screw tuner.

Compared with traditional tandem-connected circuits where a widespreaded area of the tandem is approximately equal to the summarized area of both circuits, the present invention is providing a tandem in which the widespreaded area is approximately equal to that of a single circuit. A magnet and each ferrite area of the tandem circuit according to the invention is also equal to that of a single circuit. A ferrite in the invention has the most inexpensive round shape. In order to use a transmission line within the tandem circuit according to the invention a vertical portion of a dielectric film might be used causing no effect to the tandem size and usage of material with less dielectric losses (dielectric substrate instead of a ferrite substrate).

DRAWINGS

DETAILED DESCRIPTION

Figure 1:
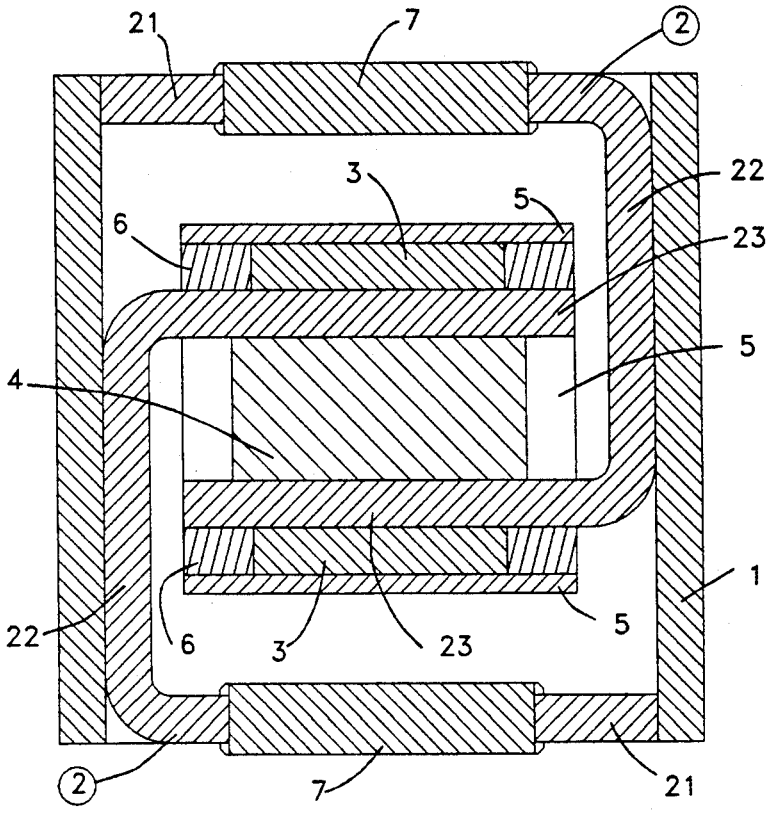
FIG. 1 is a vertical section of the main embodiment of the tandem circuit according to the present invention.

Referring to the drawings, FIG. 1 shows a tandem-connected circuit comprised of a housing 1, two magnetic circuit members 2, each having a shield portion 21, a return portion 22 and a ground plane portion 23, two ferrites 3, a permanent magnet 4, a dielectric film 5, and a dielectric substrate 6. Each ferrite 3 is located inside a dielectric substrate 6 flushed with its upper and lower surfaces. Each shield 21 is provided with a screw tuner 7.

Figure 2:
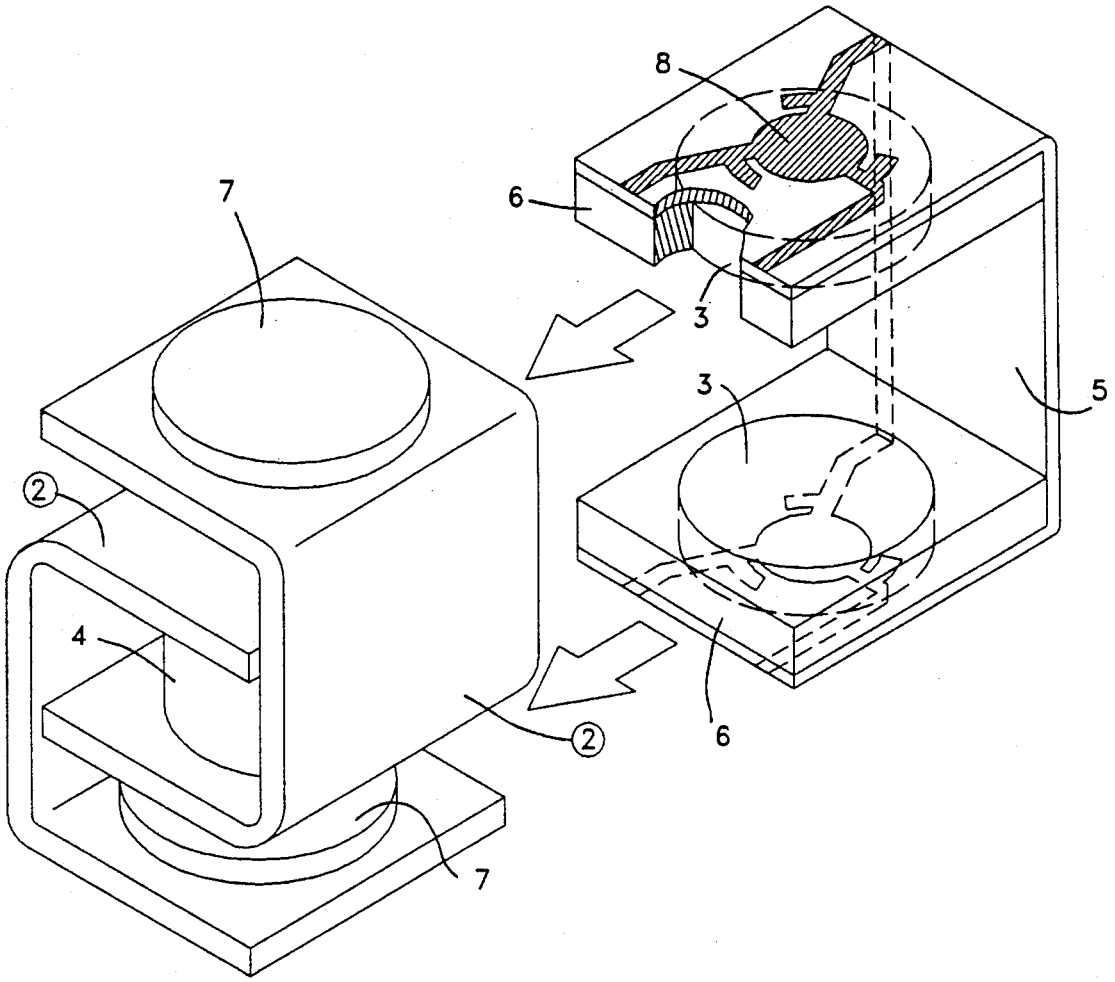
FIG. 2 is an isometric view of the same tandem circuit. An assembly having a pair of ferrites, a dielectric film, and a pair of junctions with center conductors are shown off a center line for clarity.

As it is shown on FIG. 2, each junction 8 with center conductors is located on a dielectric film 5 operatively having C-like shape, concentric on ferrite 3 and permanent magnet 4. The vertical portion (according to FIG. 2) of the film 5 is used to locate an electrical connection of center conductors. In case of a necessity to include an additional element (for example an amplifier) in between tandem-connected circuits, this vertical portion of the film 5 might also be used.

The dielectric substrate 6 is used for a convenient location of the center conductors portion of the film 5 on a surface of a ferrite 6. In principle implementation of the present concept the center conductors might be applied directly on a surface of the ferrite 5 with a cable-like electrical conductor connecting the two circuits in a tandem. In this case the film 5 and the dielectric substrate 6 are eliminated. But the main embodiment description and drawings represent both film 5 and substrate 6 as a more practical implementation of the present invention.

Figure 3:
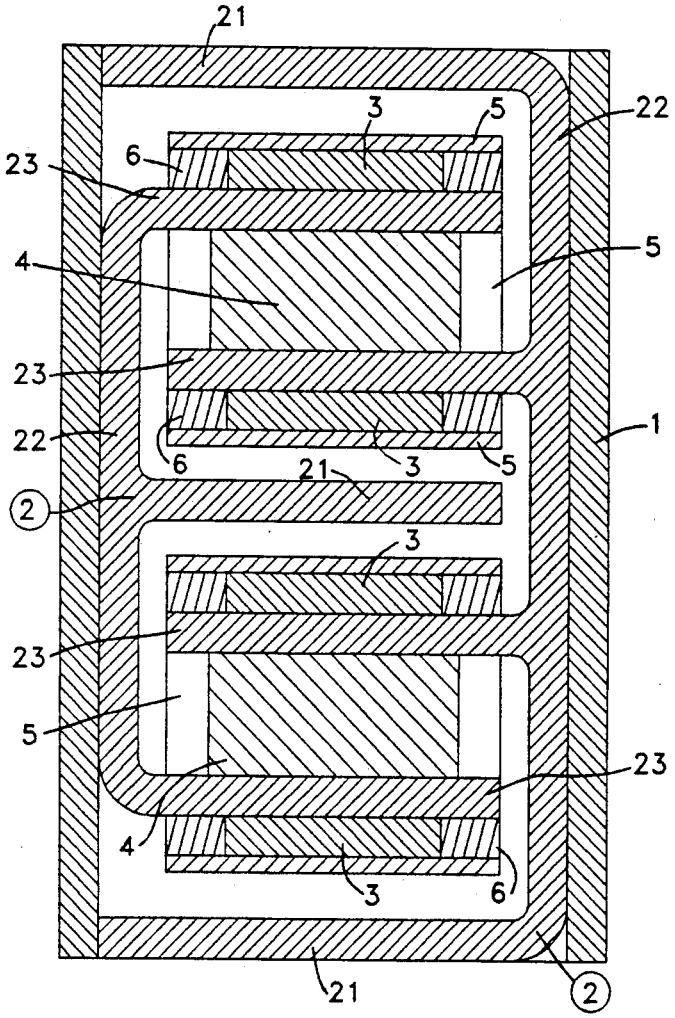
FIG. 3 is a vertical section of the optional embodiment of a multi-connected (the four-junction circuit is shown) circuit according to the concept of the present invention.

It has to be understood that the general idea of the invention herein described, and the implementation might be modified in different ways. For example, a compact multi-junction non-reciprocal circuit might be created using the concept according to the invention presented. On FIG. 3 is shown a four-junction circulator/isolator having two permanent magnets 4 and also two magnet circuit members 2 each having additional ground plane 23 and shield 21 portions. The additional portions are used in this option for better setting up magnetic flux on two additional ferrites 3 and also two additional center conductors applied on an additional dielectric film 5. It is easy to see that even in the case of a multi-junction circuit a uniform magnetic field of the limited area permanent magnets is used.

As one can see from the above description of the main and optional embodiments of the invention, better integration level in a horizontal plane, lower cost and higher quality of the tandem and multi-connected circuits might be reached compared with the conventional circuits.

What is claimed is:

1. A compact tandem non-reciprocal circuit, comprising:

a housing, a pair of junctions each with center conductors, a pair of ferrites, a magnetic circuit with a permanent magnet, wherein said pair of junctions, said pair of ferrites, and said permanent magnet are situated in a stacked manner with common center line within said housing, said magnetic circuit having a pair of C-shaped members each comprising shield, ground plane and return portions, provided that said shield portions are located toward outside of said tandem circuit, said permanent magnet is located in between inner surfaces of said ground plane portions and in contact with them, and said pair of ferrites are located each on an outer surface of said ground plane portion.

2. A compact tandem non-reciprocal circuit according to claim 1, wherein said pair of junctions with center conductors each is applied on a horizontal portion of a dielectric film operatively having a C-like shape, provided that said horizontal portions are lying each on surface of said ferrite, and the vertical portion of said film is used for application of a transmission line connecting said pair of center conductors.

3. A compact tandem non-reciprocal circuit according to claim 1 wherein said housing is made out of a non-magnetic material.

4. A compact tandem non-reciprocal circuit according to claim 1, wherein each of said shield portions is provided with a screw tuner.

5. A compact tandem non-reciprocal circuit according to claim 1, where said tandem circuit is a circulator.

* * * * *